US008322114B2

(12) United States Patent
Waters et al.

(10) Patent No.: US 8,322,114 B2
(45) Date of Patent: Dec. 4, 2012

(54) CLADDING ASSEMBLY AND METHOD OF CLADDING POSTS

(75) Inventors: Eric Scott Waters, Middleport, NY (US); Michael William Nachreiner, North Tonawanda, NY (US); Gregory F. Jacobs, Oreland, PA (US); John Zarynow, Phoenixville, PA (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 13/305,412

(22) Filed: Nov. 28, 2011

(65) Prior Publication Data

US 2012/0067002 A1 Mar. 22, 2012

Related U.S. Application Data

(60) Division of application No. 12/186,628, filed on Aug. 6, 2008, now Pat. No. 8,074,424, which is a continuation of application No. 10/940,230, filed on Sep. 14, 2004, now abandoned, which is a continuation-in-part of application No. 10/891,815, filed on Jul. 15, 2004, now abandoned, said application No. 12/186,628 is a continuation-in-part of application No. 10/891,815, filed on Jul. 15, 2004, now abandoned.

(51) Int. Cl.
*E04C 3/00* (2006.01)

(52) U.S. Cl. ..... 52/834; 52/844; 52/843; 52/287.1

(58) Field of Classification Search ..... 52/732.1, 52/732.2, 731.2, 731.3, 651.01, 651.07, 211, 52/287.1, 834, 844, 843; 256/19
See application file for complete search history.

(56) References Cited

U.S. PATENT DOCUMENTS

| | | | |
|---|---|---|---|
| 1,688,134 | A | 10/1928 | Braunstein |
| 1,917,365 | A | 7/1933 | Goertz et al. |
| D209,416 | S | 11/1967 | Smith |
| 3,413,775 | A | 12/1968 | Katz |
| D233,671 | S | 11/1974 | Gay |
| 4,019,301 | A | 4/1977 | Fox |
| 4,364,546 | A | 12/1982 | Lyman et al. |
| 4,516,756 | A | 5/1985 | Beatty |
| 4,809,470 | A | 3/1989 | Bauer et al. |
| D300,566 | S | 4/1989 | Fein |
| 5,122,401 | A | 6/1992 | Finkelstein |

(Continued)

OTHER PUBLICATIONS

U.S. Appl. No. 60/467,012, filed May 1, 2003, Stone.

(Continued)

*Primary Examiner* — Jeanette E Chapman
*Assistant Examiner* — Daniel Kenny
(74) *Attorney, Agent, or Firm* — Abel Law Group, LLP; Alexander H. Plache

(57) ABSTRACT

A cladding assembly comprises first and second cladding panels, each having top and bottom edge portions and a pair of lateral sides, and a corner connection element disposed to couple a pair of adjacent lateral sides of the first and second cladding panels together. The corner connection element includes top and bottom edge portions and a pair of lateral sides, wherein the corner connection element comprises a pair of female connectors disposed at its lateral sides and the pair of adjacent lateral sides of the first and second cladding panels comprises a pair of male connectors for mating with the female connectors, or wherein the corner connection element comprises a pair of male connectors disposed at its lateral sides and the pair of adjacent lateral sides of the first and second cladding panels comprises a pair of female connectors for mating with the male connectors of the corner connection element.

20 Claims, 8 Drawing Sheets

U.S. PATENT DOCUMENTS

| | | | |
|---|---|---|---|
| 5,228,857 | A | 7/1993 | Roland |
| 5,480,126 | A | 1/1996 | Teasdale |
| 5,526,630 | A | 6/1996 | Francis et al. |
| 5,538,178 | A | 7/1996 | Zink et al. |
| 5,642,830 | A | 7/1997 | Foster |
| 5,702,090 | A | 12/1997 | Edgman |
| 5,899,044 | A | 5/1999 | Jarrett |
| 5,899,239 | A | 5/1999 | Coulis |
| 5,904,022 | A | 5/1999 | Zadok |
| 5,956,920 | A | 9/1999 | Davis |
| 6,009,683 | A | 1/2000 | Grewe et al. |
| 6,167,672 | B1 | 1/2001 | Okitomo |
| 6,226,950 | B1 | 5/2001 | Davis |
| 6,295,783 | B1 | 10/2001 | Davis |
| 6,398,193 | B1 | 6/2002 | DeSouza |
| 6,446,824 | B1 | 9/2002 | Sluiter |
| 6,662,515 | B2 | 12/2003 | Buhrts et al. |
| 6,822,166 | B2 | 11/2004 | James et al. |
| 7,168,220 | B2 | 1/2007 | Owoc et al. |
| 2001/0022056 | A1 | 9/2001 | Gifford |
| 2003/0145555 | A1 | 8/2003 | Raskin et al. |
| 2004/0217339 | A1 | 11/2004 | Stone |
| 2005/0160697 | A1 | 7/2005 | Oliphant et al. |

OTHER PUBLICATIONS

International Search Report for PCT-US2004/039488, dated May 18, 2006.

L. B. Plastics, Inc., "Sheerline Column Clad" product literature, 2 pages.

Fukuvi USA, Inc., "Vinyl Column System" product literature, 6 pages.

Plastival "PostWrap" product literature, 1 page.

Tek-Rail Inc. "Column Wrap" drawing dated Mar. 8, 2000, 1 page.

American Way Manufacturing product sheet entitled "Vinyl Post Cladding & Trim", 1 page.

New Products from Tek-Rail, Tek-Board, Brick Mould and Post Wrap, 1 page.

Tek-Rail, Postwrap and Tek-Board pricing, 1 page.

CLADDING ASSEMBLY AND METHOD OF CLADDING POSTS

CROSS-REFERENCE TO RELATED APPLICATION

This application is a divisional of U.S. patent application Ser. No. 12/186,628 filed Aug. 6, 2008, now U.S. Pat. No. 8,074,424, which is a continuation of U.S. patent application Ser. No. 10/940,230 filed Sep. 14, 2004, abandoned, which is a continuation-in-part of U.S. patent application Ser. No. 10/891,815 filed Jul. 15, 2004, entitled "Cladding Assembly and Method of Cladding Posts", abandoned, the entirety of each of which is hereby incorporated by reference herein. U.S. patent application Ser. No. 12/186,628 is also a continuation-in-part of U.S. patent application Ser. No. 10/891,815 filed Jul. 15, 2004, entitled "Cladding Assembly and Method of Cladding Posts", the entirety of which is hereby incorporated by reference herein.

U.S. patent application Ser. No. 12/186,628 is related to commonly assigned U.S. patent application Ser. No. 10/725,768, entitled, "Single Piece Post Cladding Element, Method of Cladding a Post and Method of Forming a Cladding Element" filed Dec. 2, 2003, now U.S. Pat. No. 7,168,220, the entirety of which is hereby incorporated by reference herein.

FIELD OF THE INVENTION

The present invention relates to post cladding elements and assemblies, and methods of cladding posts.

BACKGROUND OF THE INVENTION

Posts for supporting outdoor structures such as porches, decks, boat piers and fences are clad for several reasons, including protection from the elements, reducing maintenance (e.g., painting), providing an aesthetic appearance and matching a fence system.

There are two common cladding methods. In a first method, a cladding sleeve is slipped over the post prior to installation of the post or if there is an unobstructed post end. This first cladding method and element cannot be retrofitted onto a post that is already installed (hereinafter, "pre-installed post"). If by choice or due to physical constraints (i.e., a preinstalled post) the first cladding method is not used, then the post is clad using a multi-piece cladding assembly installed around the post. Two to four piece assemblies are most common. An example of such an assembly is provided in U.S. Pat. No. 5,956,920 to Davis, entitled "Modular Post Cladding Element, Post Cladding Assembly, and Method of Cladding a Post", issued Sep. 28, 1999.

SUMMARY OF THE INVENTION

A cladding assembly comprises first and second cladding panels, each having top and bottom edge portions and a pair of lateral sides, and a corner connection element disposed to couple a pair of adjacent lateral sides of the first and second cladding panels together at a corner in cladding a building structure. The corner connection element includes top and bottom edge portions and a pair of lateral sides, wherein the corner connection element comprises a pair of female connectors disposed at its lateral sides and the pair of adjacent lateral sides of the first and second cladding panels comprises a pair of male connectors for mating with the female connectors, or wherein the corner connection element comprises a pair of male connectors disposed at its lateral sides and the pair of adjacent lateral sides of the first and second cladding panels comprises a pair of female connectors for mating with the male connectors of the corner connection element.

The cladding assembly can, if desired, fully enclose a member, such as a wooden post, to provide maintenance free and aesthetically pleasing building structure. The assembly can be used where the building structure is only partially enclosed, such as, for example, in a fascia cladding or siding corner trim applications, or deck sub-structure, columns, posts and rails. In such an application, one or more cladding panels could be applied to a building structure using connection elements to secure the cladding panels one to another, or to portions of the building structure equipped with a projection or flange suitably adapted for engaging a connection element. In this case, a portion of the building structure is clad, rather than completely surrounding the entire structure. The cladding assembly allows for easy retrofitting of an aesthetic appearance to either restore the appearance of a building structure to acceptability in the case of a deteriorated structure, or simply to change the desired aesthetics of the structure without removing it. The cladding can also be reversibly applied. If a change in appearance of a post is desired, the cladding can be removed and replaced with a cladding having a different aesthetic effect. For example, connection elements can be changed to produce different visual effects. Cladding panels could be provided with patterns, shapes or colors that could be used individually or with other patterns to yield cladded building structures having the desired attributes.

The cladding can be fit adjustably to a pre-installed structure. The connection system allows for some irregularities in the geometry of the post itself and allows a generally pleasing aesthetic effect when the cladding is fully assembled. The adjustability also enables accommodation of the cladding assembly to thermal expansion and contraction or other changes in dimension that can occur in use. The adjustability of the cladding assembly also can be beneficial when using the cladding with posts that are not of perfect dimensions. For example, if a post support structure were warped or twisted, the cladding would render a more desirable appearance.

The cladding assembly also lends itself to proper drainage. This attribute helps in drying and avoiding of water damage to the enclosed support structure over time. Further, as the cladding assembly, in one embodiment, is made up of a plurality of cladding panels, a cladding panel or panels can be easily replaced in the event of damage to a portion of the post or the cladding.

In the case of a four-sided square post, a cladding assembly can be produced by extrusion of identical cladding panels and connection elements. The cladding panels being of a single geometry simplifies the shipping and inventory needs. In the case of rectangular posts that do not have square cross sections, the cladding could be provided using one cladding panel type for the larger dimension and another cladding type for the smaller dimension, wherein the connection elements can be the same.

The cladding can also be used for more complexly shaped structures, such as, for example, hexagonal, octagonal, or higher order polygonally shaped posts or columns of varying sizes without the need for different cladding panels and connection elements for each contemplated shape to be clad.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Described herein are a cladding assembly, cladded building assembly and method of cladding a building structure. In an exemplary embodiment, the cladding is designed to clad a wood post of rectangular geometry and square cross section, although the cladding may be applied to structures formed of other materials, shapes and types, such as piers of a deck or dock, mailbox posts, columns, lamp posts, etc.

Figure 1:
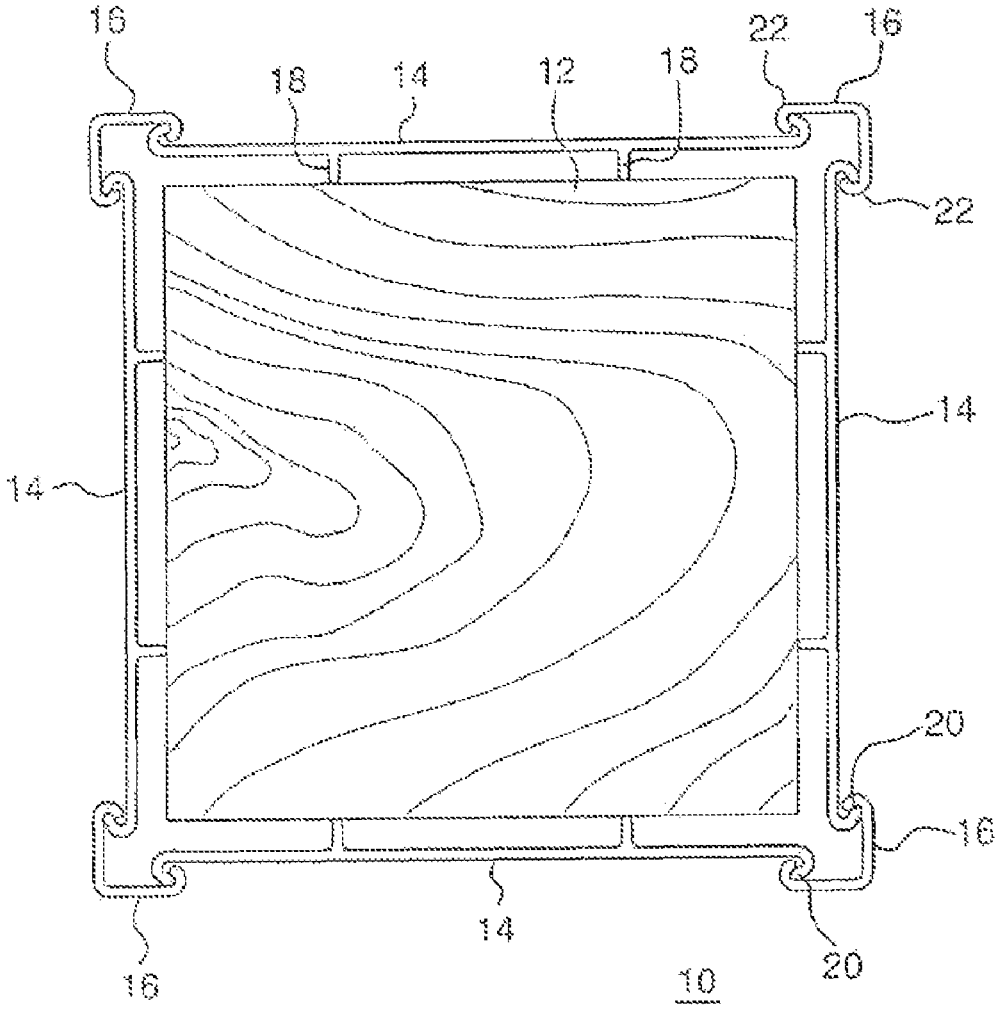
FIG. 1 is a top plan view of a cladded building assembly.

Referring first to FIG. 1, a top plan view of a cladded building assembly 10 is provided. Cladded building assembly 10 includes a rectangular wooden post 12 having a square cross section. A cladding assembly is attached to the post and includes, in the illustrated embodiment, four cladding panels 14 and four connection elements 16. The connection elements 16 provide an androgynous means of engaging the one or more cladding panels to secure the cladding panels 14 to the post 12 in cladding the post. By "androgynous" is meant that the connection between adjacent components 16 is made using geometry that is neither male nor female in the way the engagement is made.

In one embodiment, the androgynous engagement is performed by mating catches. For example, in one embodiment each connection element 16 includes a pair of inwardly extending, oppositely disposed catches 22 that mate with a pair of outwardly extending, oppositely disposed catches 20, with a catch 20 being provided one from each of an adjacent pair of cladding panels 14. As can be seen from FIG. 1, the pair of inwardly extending catches 22 of the connection elements 16 are preferably generally shaped like a pair of hooks that anchor the connection element to the outwardly extending catches 20 of a pair of adjacent cladding panels 14.

As can also be seen from FIG. 1, each cladding panel 14 preferably comprises support structure for supporting the panel against the post 12. In one embodiment, the support structure comprises support posts 18, which provide the proper spacing for cladding panels 14 with respect to the side surfaces of post 12 and provide mechanical support for the cladding panel 14.

Figure 2:
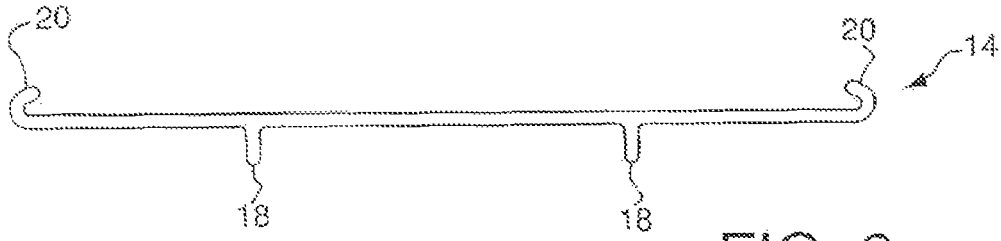
FIGS. 2 and 2A are profile views embodiments of cladding panels.
Figure 2A:
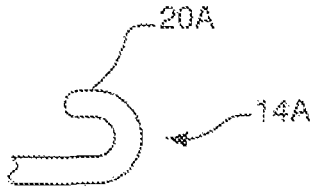

FIG. 2 is a profile view of cladding panel 14, which clearly illustrates support posts 18 and catches 20. In the embodiment of FIG. 2, the catches 20 are angled, outwardly extending catches. FIG. 2A is a partial view of a second embodiment of a cladding panel 14A illustrating that the catches 20A can be generally semicircular shaped, u-shaped or squared catches.

Figure 3:
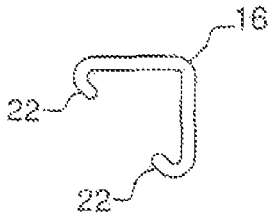
FIGS. 3, 3A and 3B are profile views of embodiments of connection elements.
Figure 3A:
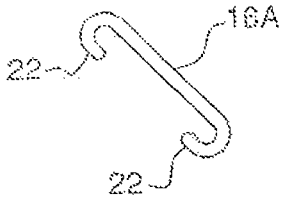
Figure 3B:
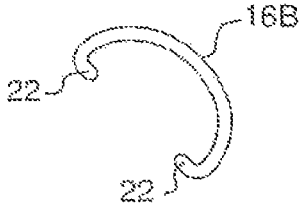

FIG. 3 illustrates a generally right angle shaped connection element 16, as also shown in FIG. 1. FIGS. 3A and 3B illustrate alternative embodiments, specifically generally flat shaped connection element 16A and rounded or arched connection element 16B, respectively.

The connection elements 16 and cladding panels 14 described herein are preferably made from a thermoplastic polymeric material. Polyvinyl chloride (PVC), polyolefins, acrylics or acrylic copolymers are preferred. The use of capstocks, over-molded or coextruded polymeric layers that are flame, UV and/or weather resistant, or contain additives for rendering their resinous compositions flame, UV and/or weather resistant, such as polypropylene, polyethylene, HMPE, PVC, ABS (acrylonitrile butadiene styrene), polyurethane, polystyrene, acrylic or ASA (acrylonitrile styrene acrylate) polymers, for example, can provide an element of increased surface durability while maintaining lower cost for the bulk of the materials making up the product. A weather resistant base polymer could be used for the connection element and cladding panels, as opposed to a capstock with a weather resistant overmold, coextrusion or additive, although this embodiment may be more expensive than using a capstock. The cladding panels and connection elements may be formed by profile extrusion, sheet extrusion, stamping, thermoforming and vacuum forming, for example. Sizing dies can also be used for shaping the composites. In a preferred embodiment, the connection element and cladding panels are co-extrusions having a weather resistant capstock on a more economical base stock.

Figure 4:
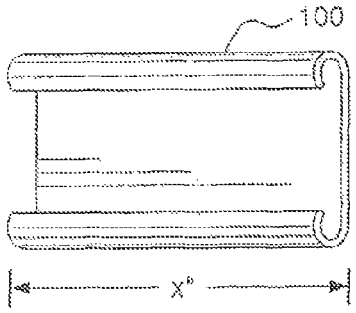
FIGS. 4-4E illustrate a method of cladding a post according to the present invention.
Figure 4A:
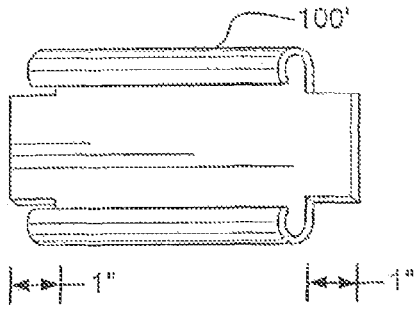

A method of installing the cladding assembly on a building structure is described in connection with FIGS. 4-4E. As shown in FIG. 4, one or more cladding panels 100 is provided having outwardly extending catches formed along its entire length. The cladding panels 100 are cut to the appropriate length (designated "X") for covering a building structure, such as a post 102. As shown in FIG. 4A, portions of the outwardly extending catches of the cladding panel are removed from at least one, and optionally both, ends of the cladding panel, forming cladding panel 100'. In one embodiment, from about 0.5-2.5", and preferably between about 0.75-2.0" and more preferably between about 1.0-1.5", of the outwardly extending catches are removed from proximate to the top and/or bottom ends of the panel 100. This removal step accommodates the application of trim or molding as described in more detail below. It should be understood, however, that the trimming step is optional and is used to accommodate the trim or molding, when used. For example, in another embodiment, the cladding is installed without the use of a trim or molding piece and no portions of the outwardly extending catches are removed. In yet another embodiment, a trim or molding piece is used having a shape that accommodates the shape of the clad building structure, including the catches and connection element without the need for removal of portions of either the catches or connection elements.

Figure 4B:
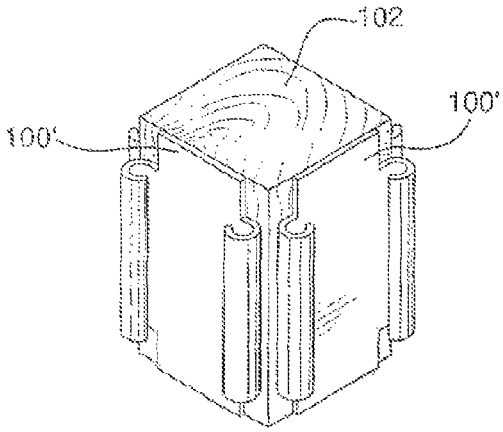

Next, as shown in FIG. 4B, one or more cladding panels 100' are aligned on a post 102. These cladding panels may be tacked using nails or otherwise directly secured to the post 102. Although not shown, it should be understood that one, two, three or four cladding panels, depending on their shapes, can be used to cover a four-sided post 102.

Figure 4C:
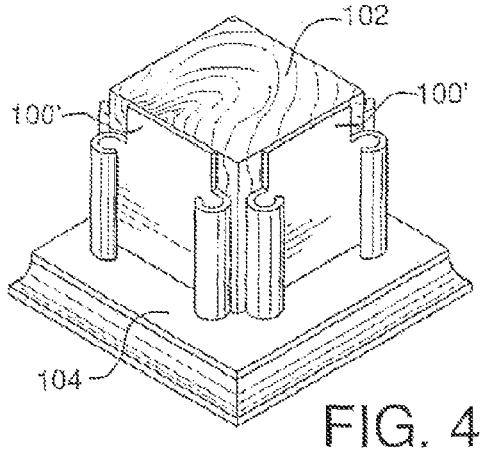

Referring to FIG. 4C, an ornamental trim or molding section 104 is constructed around the base and/or top end of the post 102 and over the portion of the cladding panels where the catches were removed. Those of ordinary skill should be familiar with the construction of trim section 104 and its details are not repeated herein. An example of the construction of trim section 104 is provided in U.S. Pat. No. 5,956,920 to Davis discussed above, the entirety of which is hereby incorporated by reference herein.

Figure 4D:
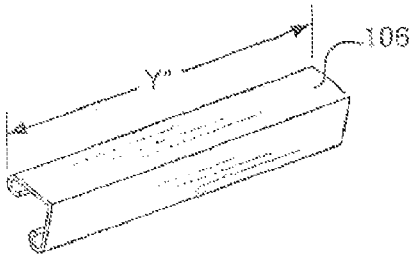
Figure 4E:
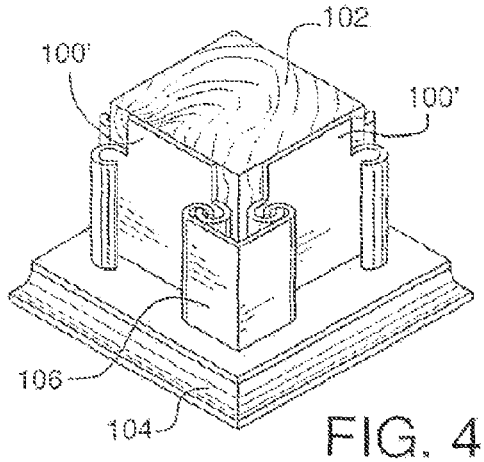

As shown in FIG. 4D, connection element 106 is cut to the proper length Y, which could be the same as or different from X, depending on the desired installation. As shown in FIG. 4E, the connection element is then snap fitted over an adjacent pair of outwardly extending catches to secure the connection element 106 to the adjacent cladding panels 100' and the cladding panels 100' to each other. The steps of FIGS. 4B, 4D and 4E can be repeated to clad the other sides of post 102. Last, a second trim or molding section 104 (not shown) can be constructed to cover the top edge of post 102, covering the area where the catches were removed from near the top edge of the panels 100'. Alternatively, cladding panels 100 may be held in place by constructed trim sections or, optionally, manually, while connection elements 106 are secured to the cladding panels to form the clad structure, such cladding holding itself in place once assembled.

It should be apparent from the foregoing that the cladding assembly can, if desired, fully enclose a member, such as a wooden post, to provide maintenance free and aesthetically pleasing building structure. The assembly can be used where the building structure is only partially enclosed, such as, for example, in a fascia cladding or siding corner trim applications, or deck sub-structure. In such an application, one or more cladding panels could be applied to a building structure using connection elements to secure the cladding panels one to another, or to portions of the building structure equipped with a projection or flange suitably adapted for engaging a connection element. In this case, a portion of the building structure is clad, rather than completely surrounding the entire structure. Optionally, an additional anchoring means could be used, such as, for example, a screw, staple or nail, in attaching the cladding to the building structure. While fasteners may be optionally used, the cladding assembly lends itself to be applied without the need for additional fasteners or glue and may provide a self supporting structure.

The cladding assembly allows for easy retrofitting of an aesthetic appearance to either restore the appearance of a building structure to acceptability in the case of a deteriorated structure, or simply to change the desired aesthetics of the structure without removing it. The cladding can also be reversibly applied. If a change in appearance of a post is desired, the cladding can be removed and replaced with a cladding having a different aesthetic effect. For example, connection elements can be changed to produce different visual effects. Cladding panels could be provided with patterns, shapes or colors that could be used individually or with other patterns to yield clad building structures having the desired attributes.

It should be apparent that the cladding can be fit adjustably to an existing structure that is already in place. The cladding does not need to be slipped over one end of the post. The connection system allows for some irregularities in the geometry of the post itself and allows a generally pleasing aesthetic effect when the cladding is fully assembled. The adjustability also enables accommodation of the cladding assembly to thermal expansion and contraction or other changes in dimension that can occur in use. The adjustability of the cladding assembly also can be beneficial when using the cladding with posts that are not of perfect dimensions. For example, if a post support structure were warped or twisted, the cladding would render a more desirable appearance. Also, the cladding can be used on a support structure that is purely structural in its load-bearing capability, such as a pipe, floor jack or a section of angle iron, for example, to provide a pleasing finished look to a post so clad.

The cladding assembly also lends itself to proper drainage. This attribute helps in drying and avoiding of water damage to the enclosed support structure over time. Further, as the cladding assembly, in one embodiment, is made up of a plurality of cladding panels, a cladding panel or panels can be easily replaced in the event of damage to a portion of the post or the cladding.

In the case of a four-sided square post, a cladding assembly can be produced by extrusion of identical cladding panels and connection elements. The cladding panels being of a single geometry simplifies the shipping and inventory needs. In the case of rectangular posts that do not have square cross sections, the cladding could be provided using one cladding panel type for the larger dimension and another cladding type for the smaller dimension, wherein the connection elements can be the same.

The cladding can also be used for more complexly shaped structures, such as, for example, hexagonal, octagonal, or higher order polygonally shaped posts or columns of varying sizes without the need for different cladding panels and connection elements for each contemplated shape to be clad.

As noted above, a preferred building structure for cladding is a post. Four cladding panels could be provided along with four connection elements for cladding a square post. Alternatively, a given panel section could cover more than one side of the post such that, for example, two panel sections could be connected to wrap the post. Another approach would be to provide a single four sided panel that includes a subsection for each of the four sides with a connection element to close and hold the cladding in place. A single piece post cladding element that could be adapted for this purpose is disclosed in commonly assigned U.S. patent application Ser. No. 10/725,768, entitled, "Single Piece Post Cladding Element, Method of Cladding a Post and Method of Forming a Cladding Element" filed Dec. 2, 2003, the entirety of which is hereby incorporated by reference herein.

Figure 5:
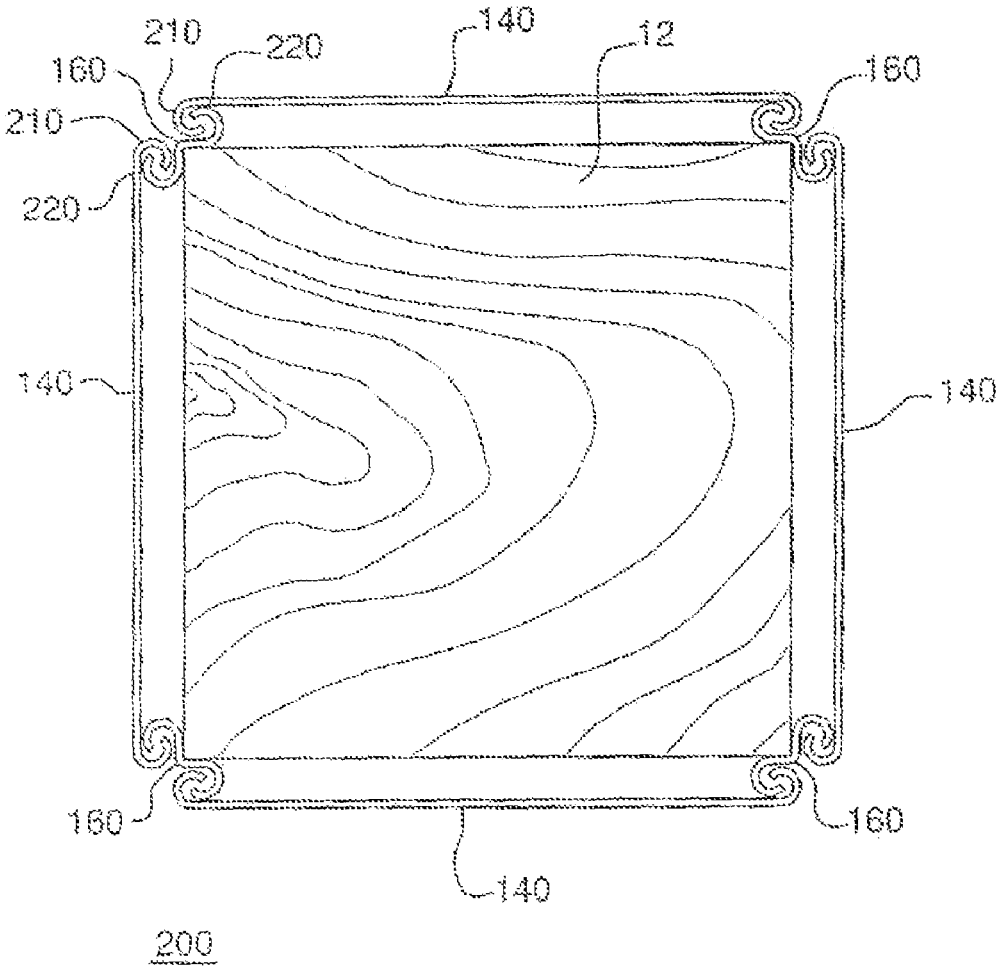
FIG. 5 is a top plan view of an alternative embodiment of a cladded building assembly.

FIG. 5 is a top plan view of an alternative cladded building assembly 200. Assembly 200 includes a rectangular wooden post 12 having a square cross section. A cladding assembly is attached to the post and includes, in the illustrated embodiment, four cladding panels 140 and four connection elements 160. The connection elements 160 provide an androgynous means of engaging the one or more cladding panels to secure the cladding panels 140 to the post 12 in cladding the post. In this embodiment, the androgynous engagement is performed by a pair of outwardly extending, oppositely disposed catches 220 that mate with a pair of inwardly extending, oppositely disposed catches 210, with a catch 210 being provided one from each of an adjacent pair of cladding panels 140. As can be seen from FIG. 5, the pair of outwardly extending catches 220 of the connection elements 160 are preferably generally shaped like a pair of hooks that anchor the connection element to the inwardly extending catches 210 of a pair of adjacent cladding panels 140. The assembly 200 can be constructed in the manner described above in connection with, for example, FIGS. 4-4E.

In an alternative embodiment of a cladding panel assembly, the at least one connection element includes a pair of oppositely disposed male connectors, and the at least one cladding panel has a pair of oppositely disposed female connectors for mating with the oppositely disposed male connectors. Alternatively, the at least one connection element includes a pair of oppositely disposed female connectors, and the at least one cladding panel has a pair of oppositely disposed male connectors for mating with the oppositely disposed female connectors of the connection element.

Figure 8:
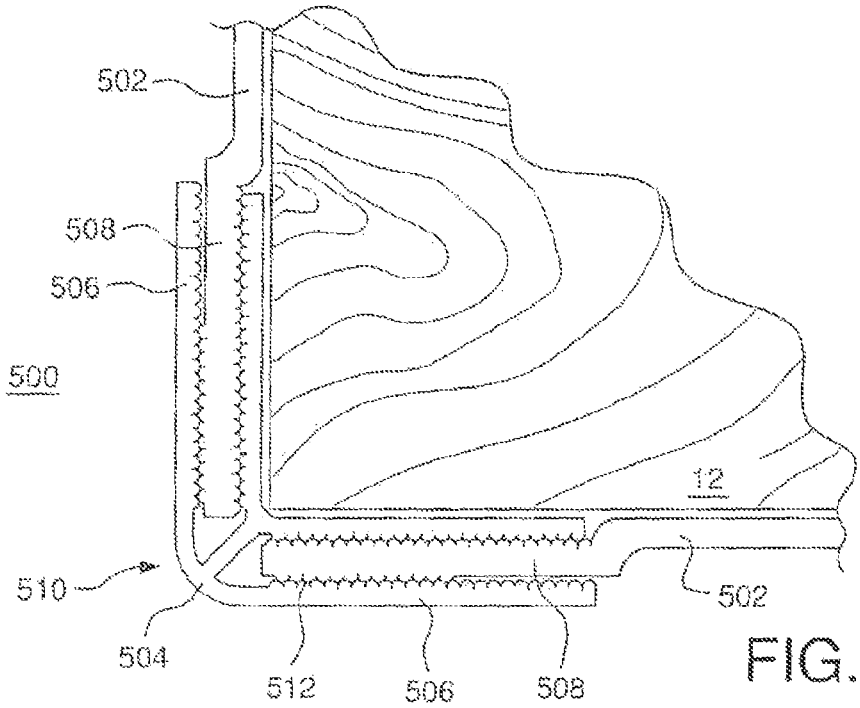
FIGS. 8 and 8A are each a partial top plan view of an alternative embodiment a cladded building assembly comprising male-female connections.

FIG. 8 is a partial top plan view of a building assembly 500 using male-female connections to couple the connector and adjacent siding panels in cladding a building structure, such as pre-installed post 12. The corner connection element 504 has interior and exterior surfaces, top and bottom edges and a pair of lateral sides. In this embodiment, the lateral sides include a pair of generally "U" shaped female connectors 506. The assembly 500 also includes a pair of adjacent cladding panels 502 that are coupled together at corner 510 by the corner connection element 504. Like the corner connection element 504, each cladding panel 502 has interior and exterior surfaces, top and bottom edges and a pair of lateral sides. Only one lateral side for each cladding panel 502 is shown, as only one corner 510 of the assembly 500 is shown. Each cladding panel 502 includes a male connector 508 at a lateral side that mates with the female connector 506 as shown.

In an exemplary embodiment, the male connectors 508 and female connectors include frictional elements for improving the connection between the male and female connectors. For example, as shown in the embodiment 500 of FIG. 8, the frictional elements may include tiny protrusions, bumps or teeth 512, for example, tapered or square, that mate and help to better interlock the cladding panels 502 and corner connection element 506. Optionally, these bumps or teeth 512 could be angled to facilitate insertion of the male elements while making removal more difficult.

Figure 9:
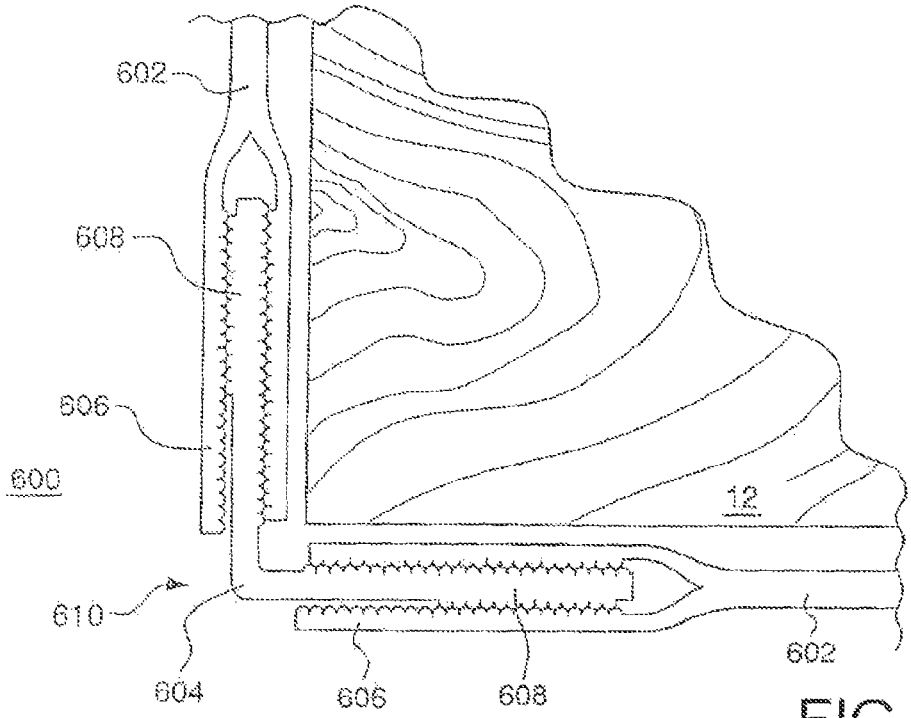
FIG. 9 is a partial top plan view of a second alternative embodiment of a cladded building assembly comprising male-female connections.

FIG. 9 is a partial top plan view of an alternative building assembly 600 using male-female connections to couple the connector and adjacent siding panels in cladding a building structure, such as post 12. The corner connection element 604 has interior and exterior surfaces, top and bottom edges and a pair of lateral sides. In this embodiment, the lateral sides of corner connection element 604 include a pair of male connectors 608. The assembly 600 also includes a pair of adjacent cladding panels 602 that are coupled together at corner 610 by the corner connection element 604. Like the corner connection element 604, each cladding panel 602 has interior and exterior surfaces, top and bottom edges and a pair of lateral sides. Only one lateral side for each cladding panel 602 is shown, as only one corner 610 of the assembly 600 is shown. Each cladding panel 602 includes a generally "U" shaped female connector 606 at a lateral side that mates with an adjacent male connector 608 of the corner connection element 604 as shown.

Figure 8A:
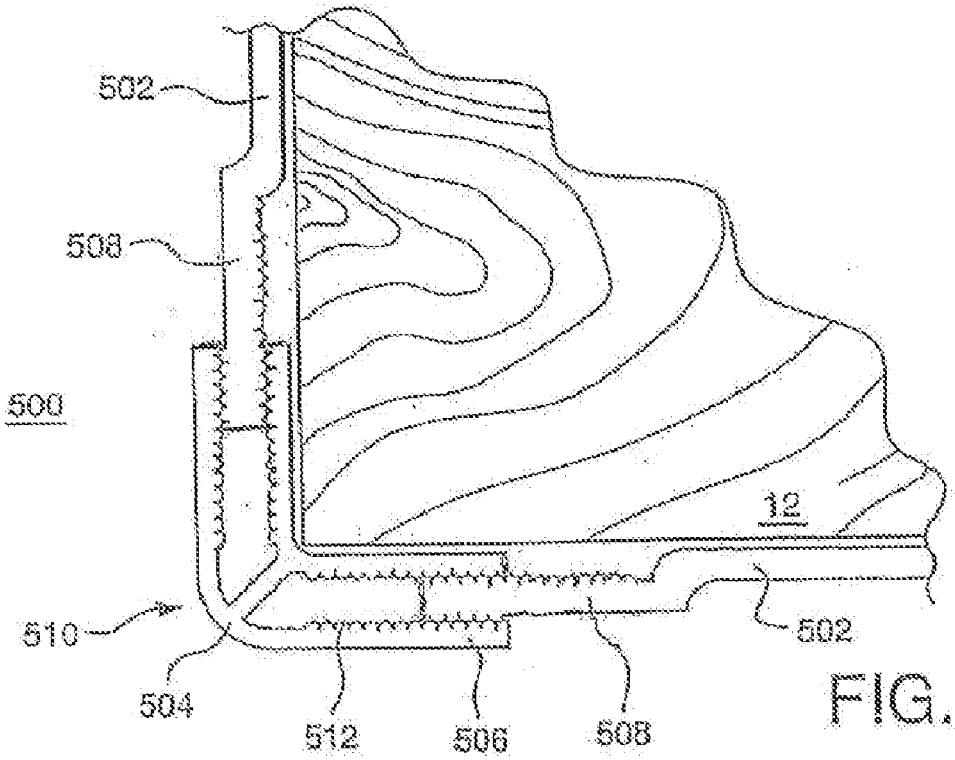

Exemplary embodiments of assemblies 500 and 600 for cladding four sided exposed posts or other structures utilize four cladding panels 502, 602 and four corner connection elements 504, 604, respectively, although other configurations are certainly possible and are contemplated. Building assemblies 500, 600 can be constructed in much the same manner as described above in connection with FIGS. 4-4E. For example, with respect to embodiment 500, once cladding panels 502 are secured to post 12, connection element 504, which is preferably made from a flexible thermoplastic, can be snapped into place as shown in FIG. 8 or FIG. 8A. As shown in FIG. 8A, for example, the lengths of male connectors 508 and/or the female connectors 506 can be shortened slightly from what is shown in FIG. 8 to facilitate this connection if desired. Alternatively, the connector 504 could be placed vertically over the male connectors and slid down onto the male connectors 504, with the male connectors 504 disposed in the female connector 506, thereby completing the connection. Assembly 600 may be formed in a similar manner, only with male connectors 608 being inserted into female connectors 606.

Figure 6:
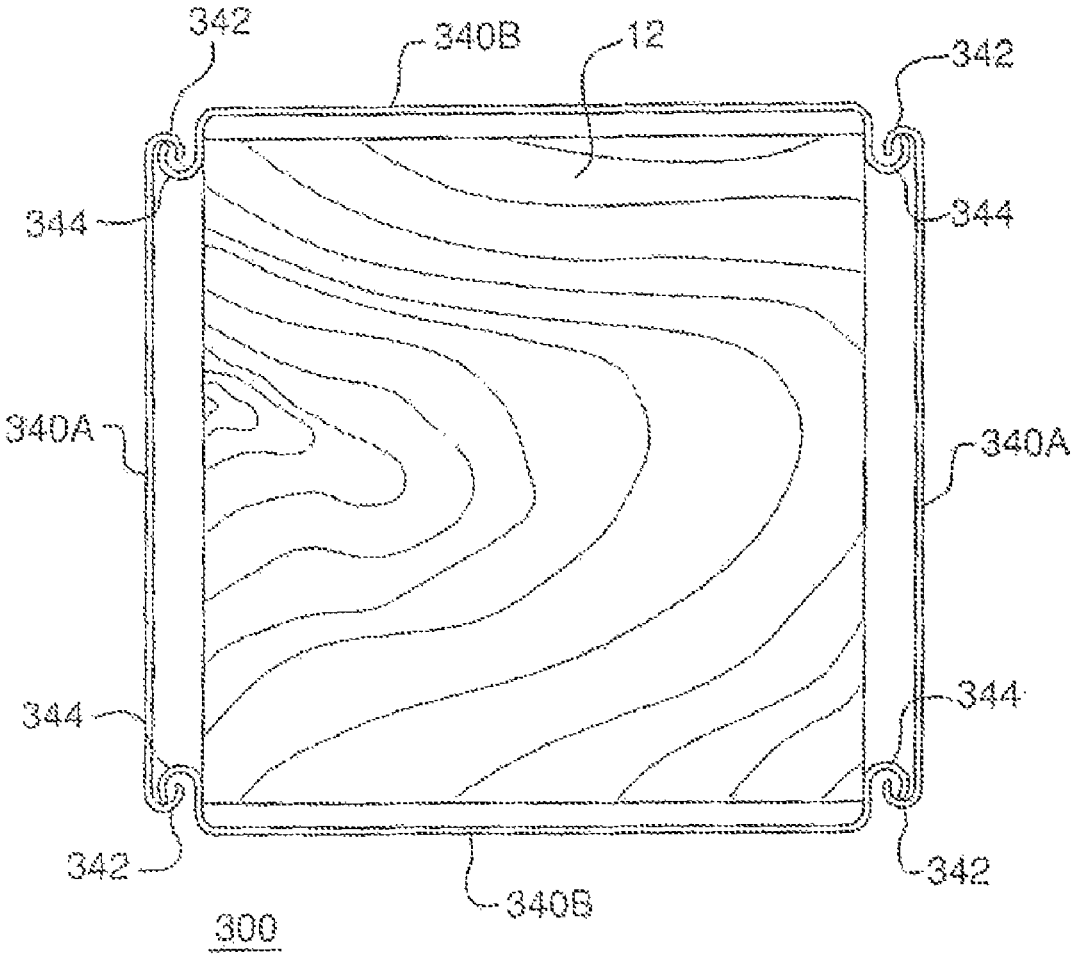
FIG. 6 is a top plan view of another alternative embodiment of a cladded building assembly.

In another alternative embodiment of a building assembly 300 shown in FIG. 6, the connection element is integral with the cladding panels 340A, 340B. In the illustrated embodiment including four cladding panels, the cladding assembly includes two cladding panels 340A each including a pair of inwardly extending catches 342 and two cladding panels 340B each including a pair of outwardly extending catches 344. In this embodiment, catches 342 of a cladding panel 340A mate with catches 344 of an adjacent cladding panel 340B proximate to each corner of post 12. As should be understood, this assembly can be constructed with one, two, three or four cladding panels.

Figure 7:
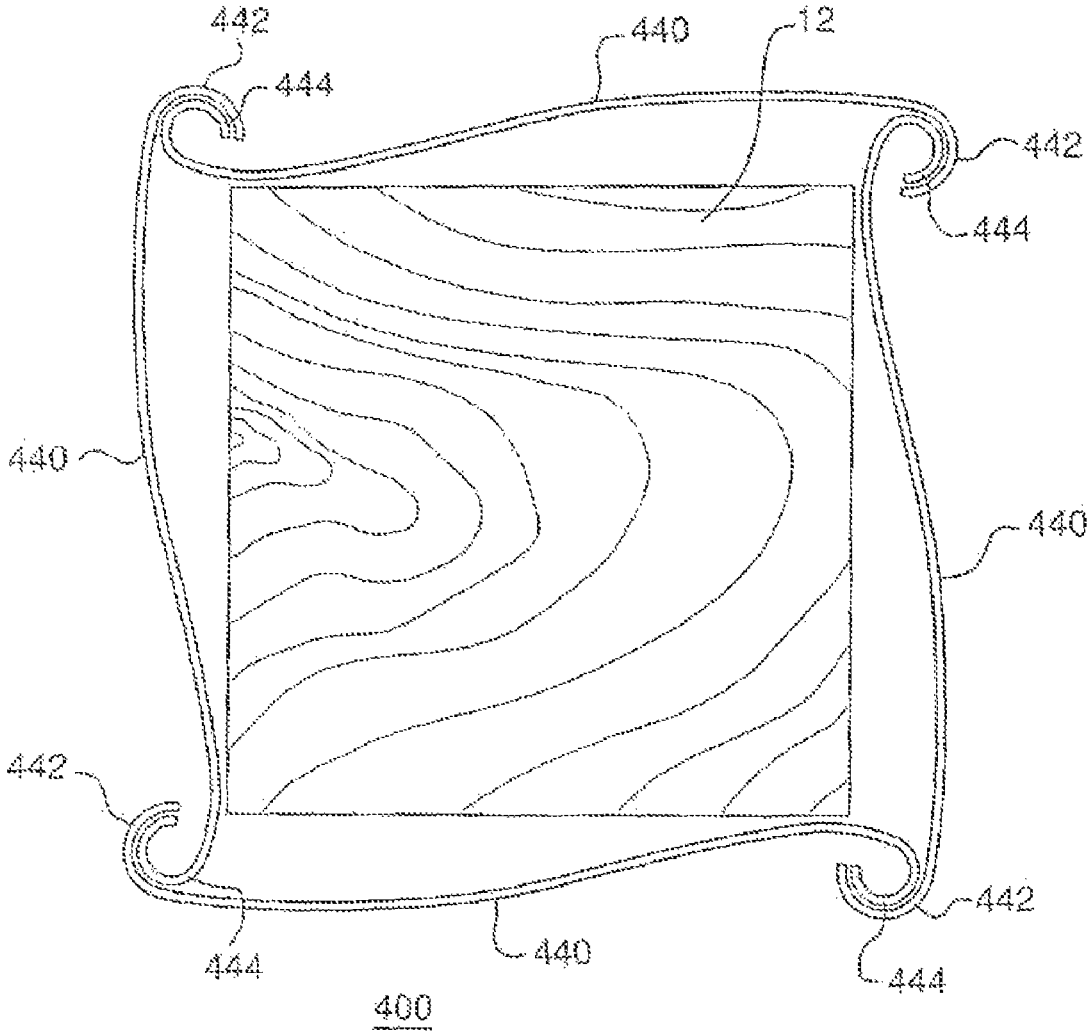
FIG. 7 is a top plan view of another alternative embodiment of a cladded building assembly.

FIG. 7 is a top plan view of another alternative embodiment of a building assembly 400 where the connection element is integral with the cladding panels 440. Each cladding panel is identical and roughly shaped like an "S". In this embodiment, each cladding panel has an inwardly extending catch 442 and an outwardly extending catch 444. The inwardly extending catches 442 are similarly shaped and larger (though differently oriented) than the outwardly extending catches 444 such that an inwardly extending catch 442 of a first cladding panel 440 can fit around the outwardly extending catch 444 of an adjacent second cladding panel 440 to secure the cladding panels together.

The cladding assemblies have been described, in one embodiment, as including a 4"×4" square post. A larger post, such as a 6"×6" post, can be clad in at least two ways using inventory available for cladding the 4"×4" post. In a first embodiment, the cladding panels used to clad the 4"×4" post are used. Enlarged connection elements are then used to connect the cladding panels together and to cover the portion of the 6"×6" post not covered by the cladding panels designed for the 4"×4" post. In the second embodiment, wider cladding panels about 6" or more in width can be secured to the 6"×6" post with connection elements from the 4"×4" post embodiment. These embodiments allow for larger post to be clad while utilizing inventory available to clad smaller posts. Alternatively, slightly wider (i.e., wider than the 4"×4" post embodiment) cladding panels and slightly larger (larger than the 4"×4" post embodiment) connection elements could be used.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. An aesthetic cladding assembly for cladding a post, comprising:

a plurality of polymeric cladding panels, each cladding panel having top and bottom edges, a pair of opposite lateral edges and respective catches extending along the length of the lateral edges;

a plurality of polymeric corner connection elements for connecting adjacent cladding panels together in cladding the post, wherein each corner connection element includes a pair of catches for mating with the catches of the cladding panels; and a decorative trim section for finishing an end of the cladding assembly, wherein a first end portion of each catch of the cladding panels is spaced from the bottom or top edge of the cladding panel, thereby providing space for installation of the decorative trim section at the end of the cladding assembly.

2. The aesthetic cladding assembly of claim 1, wherein one or both of the connection elements and cladding panels is sufficiently flexible so as to permit a snap fit engagement between the connection elements and the cladding panels.

3. The aesthetic cladding assembly of claim 2, wherein the connection elements are flexible about a longitudinal axis thereof.

4. The aesthetic cladding assembly of claim 1, wherein an opposite end portion of each catch of the cladding panels is also spaced from the top or bottom edge of the cladding panel, thereby providing space for installation of a second decorative trim section for finishing an opposite end of the cladding assembly.

5. The aesthetic cladding assembly of claim 1, wherein each catch of the cladding panels is generally u- or semicircular-shaped.

6. The aesthetic cladding assembly of claim 1, wherein the cladding panels and connection elements are formed from a thermoplastic polymeric material.

7. A cladded post installation, comprising:

a post having a plurality of outer faces;

a plurality of polymeric cladding panels installed on the outer faces of the post, each cladding panel having top and bottom edges, a pair of opposite lateral edges and respective catches extending along the length of the lateral edges;

a plurality of polymeric corner connection elements connecting adjacent cladding panels together at corners of the post, wherein each corner connection element includes a pair of catches mated with the catches of the cladding panels; and a decorative trim section disposed to finish an end of the cladding assembly, wherein a first end portion of each catch of the cladding panels is spaced from the bottom or top edge of the cladding panel, thereby providing space for installation of the decorative trim section at the end of the cladding assembly.

8. The cladded post installation of claim 7, wherein each of the corner connection elements is reversibly secured at a respective corner of the post to a pair of adjacent cladding panels with a snap fit engagement, wherein the snap fit engagement holds the corner connection element to the pair of adjacent cladding panels under tension.

9. The cladded post installation of claim 7, wherein one or both of the connection elements and cladding panels is sufficiently flexible to permit a snap fit engagement between the connection elements and the cladding panels.

10. The cladded post installation of claim 9, wherein the connection element are flexible about a longitudinal axis thereof.

11. The cladded post installation of claim 7, wherein the decorative trim section is disposed at least in part in the space provided at the first end portion of each catch and the corner connection elements are disposed over an upper surface of the decorative trim section.

12. The cladded post installation of claim 7, wherein each catch of the cladding panels is generally u- or semicircular-shaped.

13. The cladded post installation of claim 7, wherein the first end portion of each catch of the cladding panels is spaced from a bottom edge of the cladding panel, and wherein the decorative trim section is disposed underneath the corner connection element and around the outer faces of the post.

14. The cladded post installation of claim 7, wherein the first end portion of each catch of the cladding panels is spaced from a bottom edge of the cladding panel, and wherein the decorative trim section is disposed underneath the catches of the cladding panels and around the outer faces of the post.

15. An aesthetic cladding assembly for cladding a post, comprising:

a plurality of polymeric cladding panels, each cladding panel having top and bottom edges, a pair of opposite lateral edges and respective catches extending along the length of the lateral edges;

a plurality of polymeric corner connection elements for connecting adjacent cladding panels together in cladding the post, wherein each corner connection element includes a pair of catches for mating with the catches of the cladding panels; and a decorative trim section for finishing a bottom end of the cladding assembly, wherein a first end portion of each catch of the cladding panels is spaced from the bottom edge of the cladding panel, thereby providing space for installation of the decorative trim section at the bottom end of the cladding assembly.

16. The aesthetic cladding assembly of claim 15, wherein one or both of the connection elements and cladding panels is sufficiently flexible so as to permit a snap fit engagement between the connection elements and the cladding panels.

17. The aesthetic cladding assembly of claim 15, wherein the connection elements are flexible about a longitudinal axis thereof.

18. The aesthetic cladding assembly of claim 15, wherein each catch of the cladding panels is generally u- or semicircular-shaped.

19. The aesthetic cladding assembly of claim 15, wherein the cladding panels and connection elements are formed from a thermoplastic polymeric material.

20. The aesthetic cladding assembly of claim 15, wherein the plurality of polymeric cladding panels consists of four cladding panels and the plurality of polymeric corner connection elements consists of four corner connection elements.

* * * * *